United States Patent [19]

Glassey

[11] Patent Number: 5,069,140

[45] Date of Patent: Dec. 3, 1991

[54] LOADING AND UNLOADING ARRANGEMENT FOR A CABLE TRANSPORTATION SYSTEM

[76] Inventor: Paul Glassey, Sornard, CH-1961 Haute-Nendaz, Switzerland

[21] Appl. No.: 254,682

[22] Filed: Oct. 7, 1988

[30] Foreign Application Priority Data

Oct. 15, 1987 [CH] Switzerland ..... 4044/87-6

[51] Int. Cl.[5] ..... B61B 1/00; B61B 11/00; B61J 3/00

[52] U.S. Cl. ..... 104/28; 104/88; 104/173.2

[58] Field of Search ..... 104/20, 28, 30, 173.2, 104/18, 29, 89, 88, 178, 100, 104, 131, 27, 67

[56] References Cited

U.S. PATENT DOCUMENTS

| | | | |
|---|---|---|---|
| 1,820,034 | 8/1931 | Schuberth | 104/27 |
| 3,675,584 | 7/1972 | Hall | 104/28 |
| 3,735,710 | 5/1973 | Hickman | 104/20 X |
| 3,880,085 | 4/1975 | Jacobs, Jr. et al. | 104/131 X |
| 3,910,196 | 10/1975 | Denenburg | 104/20 |
| 4,050,385 | 9/1977 | Gurr et al. | 104/173.2 |
| 4,662,285 | 5/1987 | Rossignol | 104/173.2 |

FOREIGN PATENT DOCUMENTS

| | | |
|---|---|---|
| 125967 | 11/1984 | European Pat. Off. . |
| 170587 | 2/1986 | European Pat. Off. . |
| 2050964 | 4/1971 | France . |

*Primary Examiner*—Robert J. Oberleitner
*Attorney, Agent, or Firm*—Spencer & Frank

[57] ABSTRACT

A transportation system includes a continuously moving traction cable; a plurality of carriers connectable to and disconnectable from the traction cable; a station for receiving, loading, unloading and dispatching the carriers; an uncoupling zone at the entrance side of the station for disconnecting each carrier from the traction cable; a coupling zone at the exit side of the station for reconnecting each carrier to the traction cable; an unloading zone and a loading zone situated between the uncoupling and coupling zones; a transfer rail assembly extending from the uncoupling zone to the coupling zone through the unloading and loading zones for guiding the disconnected carriers; and additional unloading zone and an additional loading zone situated between the uncoupling and coupling zones at a level different from that where the first-mentioned unloading and loading zones are located; an additional transfer rail assembly connecting the additional unloading and loading zones with one another; and a conveyor assembly connecting the uncoupling zone with the additional unloading zone and connecting the additional loading zone with the coupling zone.

7 Claims, 4 Drawing Sheets

LOADING AND UNLOADING ARRANGEMENT FOR A CABLE TRANSPORTATION SYSTEM

BACKGROUND OF THE INVENTION

This invention relates to a transportation system which comprises a continuously moving traction cable circulating between stations and pulls carriers, such as cable cars, gondolas, lift chairs and the like for personal or freight use. The carriers are adapted to be uncoupled from the cable in an uncoupling zone at the entrance of each station and coupled to the cable in a coupling zone at the exit of each station. The transportation system further has a transfer rail assembly leading from the uncoupling zone to the coupling zone while passing through an unloading (freight discharging or passenger disembarking) zone and a loading (freight charging or passenger boarding) zone.

In establishing transportation systems of the above type, whether on mountains for tourism or sport or in a flat terrain for urban transport or on exposition grounds, a number of problems are encountered involving building structures at the terminals of the transportation system, for example, valley and mountain stations as well as intermediary stations. The usual passenger discharge rate of cable-suspended carriers is approximately 3,000 persons per hour and each carrier has usually a capacity of two to twelve persons. This requires a carrier departure every 5 to 10 seconds, dependent upon the size of the carrier. The delay required for disembarking and boarding is approximately 30 to 60 seconds, dependent on the size of the carrier, and the season, since in the mountains, at winter time, the majority of the passengers have to place their skis on ski racks which are generally located externally of the carrier (such as a gondola). Consequently, a substantial number of carriers is located at any given time simultaneously in the disembarking and boarding zones and also, a significant number of passengers has, at any given time, just left the vehicle or is about to board. In order to avoid passenger congestion problems within the stations, it is therefore a requirement that such zones be relatively spacious. Topographic or urban conditions, however, often do not allow the construction of a station which is sufficiently large to house long zones for disembarkation and boarding. Furthermore, such zones would not represent an ideal situation in view of the fact that the passenger traffic undergoes very significant fluctuations dependent on the season, the time of the day, as well as snow and weather conditions.

It has already been attempted to separate the carriers and to pass them through two disembarkation zones and two boarding zones which are situated at the same height level in a parallel relationship between the entrance and the exit sides of the carriers. Such a solution, however, is disadvantageous for this reason: the paths of passengers and carriers necessarily cross one another which increases the risk of accidents and requires more stringent safety measures. In order to avoid the crossing of the paths, it would be feasible to provide a staircase by means of which at least a part of the passengers could gain direct access to the disembarkation zone and the boarding zone. Such a solution, however, requires relatively large space on one level.

SUMMARY OF THE INVENTION

It is an object of the invention to provide a loading and unloading arrangement of the above-outlined type from which the discussed disadvantages are eliminated and which is adaptable to widely varying traffic conditions and may be installed on a relatively small surface.

This object and others to become apparent as the specification progresses, are accomplished by the invention, according to which, briefly stated, the transportation system includes a continuously moving traction cable; a plurality of carriers connectable to and disconnectable from the traction cable; a station for receiving, loading, unloading and dispatching the carriers; an uncoupling zone at the entrance side of the station for disconnecting each carrier from the traction cable; a coupling zone at the exit side of the station for reconnecting each carrier to the traction cable; an unloading zone and a loading zone situated between the uncoupling and coupling zones; a transfer rail assembly extending from the uncoupling zone to the coupling zone through the unloading and loading zones for guiding the disconnected carriers; an additional unloading zone and an additional loading zone situated between the uncoupling and coupling zones at a level different from that where the first-mentioned unloading and loading zones are located; an additional transfer rail assembly connecting the additional unloading and loading zones with one another; and a conveyor assembly connecting the uncoupling zone with the additional unloading zone and connecting the additional loading zone with the coupling zone.

The above-outlined new arrangements within the buildings according to the invention as well as the choice of the appropriate conventional electromechanical equipment makes possible to move the loaded carriers in a state where they are disconnected from the traction cable. The system provides for the possibility to load and unload in different zones which essentially are located above one another, that is, at different height levels. This permits to utilize one or the other or all of the loading and unloading zones, dependent upon the degree of congestion. Thus, for example, at the departure zone of a station in a winter morning the passenger traffic is greater at a lower level, while later in the day, when the installation is occupied by the users of the slopes served by the installation, boarding is often more logical at a higher level.

Furthermore, it is feasible to use one of the zones for passengers and the other for freight, or separating different categories of passengers, such as separating skiers from other tourists.

DESCRIPTION OF THE PREFERRED EMBODIMENTS

Figure 1:
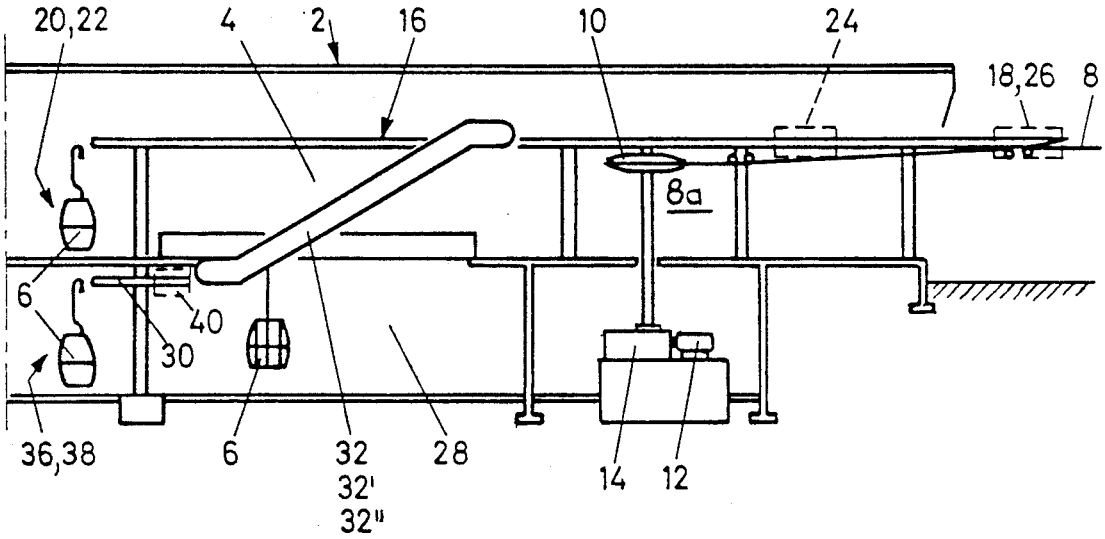
FIG. 1 is a schematic side elevational view of a cable car terminal located in the valley (bottom terminal), according to embodiment of the invention.
Figure 2:
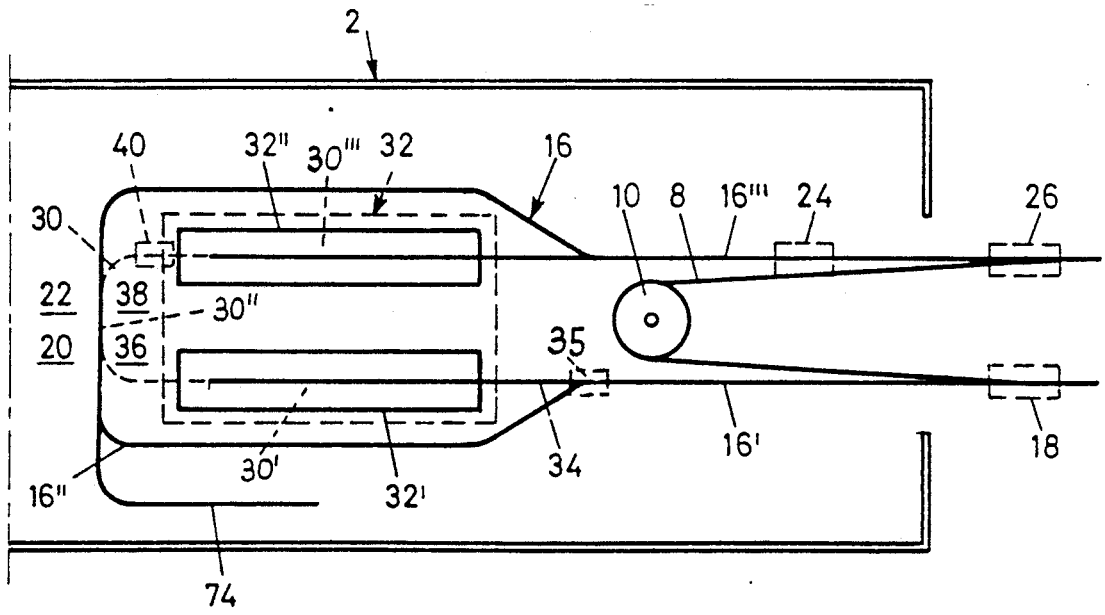
FIG. 2 is a top plan view of the construction shown in FIG. 1.

Turning to FIGS. 1 and 2, there is illustrated therein a valley (bottom) station for a monocable aerial car system, including a station building 2 having a principal floor 4. The gondolas 6, each having a capacity of two to twelve persons, may be uncoupled from an aerial traction cable 8 in a conventional manner. The aerial cable 8 enters and exits the building 2 as it is in a zone of reversal 8a, supported and guided by an end wheel (cable-deflecting wheel) 10 rotated by a motor 12 with the intermediary of a gear box 14. A rail system 16 is mounted on the ceiling of the main floor 4. The rails form essentially a "U" with rail portions 16', 16" and 16'". The main floor 4 contains several zones, that is, an uncoupling zone 18, a debarkation zone 20, a boarding zone 22 adjacent the debarkation zone 20, a standby zone 24 and a coupling zone 26. The uncoupling zone 18 is the location where the gondolas 6 are, upon arrival from the mountain station, uncoupled from the cable 8 and shifted onto the rail portion 16' of the rail system 16. The gondolas 6 travel towards the debarkation zone 20, losing some of their speed as a result of friction or a conventional braking mechanism. In case there is an excessive deceleration of the gondolas, manual pushing will shift them to the desired location.

As the gondolas 6 arrive in the debarkation zone 20, they are automatically or manually stopped. The passengers leave the gondolas 6 and, as the case may be, take their skis or bags from a ski rack or luggage rack mounted to the exterior of the gondola. Thereafter, the gondolas 6 are displaced towards the boarding zone 22 where the new passengers load their skis or luggage and take their places in the gondola. In case the building is not separated into a first part for passengers ready to board and a second part for passengers just leaving the car, the boarding and debarkation zones are combined in the same location. The occupied gondolas 6 are thereafter displaced towards the waiting or standby zone 24 from which they are moved away, generally automatically in regular intervals towards the coupling zone 26. As each gondola 6 is coupled anew to the cable 8, it leaves the station, drawn by the cable.

The above-described installations and their mode of operation are conventional.

In the station according to the invention, the building 2 has a secondary floor 28 which is situated at a level different from that of the principal floor 4. In the embodiment of FIGS. 1 and 2, the secondary floor 28 is disposed below the level of the principal floor 4. A second rail system 30, 30', 30", 30'", also of "U"-shaped course, is mounted on the ceiling of the secondary floor 28. A conveyor system 32 is arranged obliquely and has a descending rail portion 32' and an ascending rail portion 32". The conveyor system 32 connects a rail portion 34 of the first system of rails 16 to the rail portion 30' of the second rail system 30. A rail switch system 35 mounted on the rail portion 16' serves alternatively the rail portion 34 or the rail portion 16".

On the secondary floor 28 there are provided a second debarkation zone 36, a second boarding zone 38 and a second waiting zone 40. As may be observed in FIGS. 1 and 2, the debarkation zone 36 and the boarding zone 38 on the secondary floor 28 are located generally vertically below the debarkation zone 20 and the boarding zone 22 on the principal floor 4. As on the principal floor, the debarkation and boarding zones may be combined. By means of the switch system 35 one part of the gondolas which arrive on the first rail system 16 is automatically or manually selected and directed to the descending rail portion 32' of the conveyor system 32 which thus lowers the gondolas 6 to the secondary floor 28. As the gondolas 6 leave the descending rail portion 32', they arrive, by means of the second rail system 30, in the second debarkation zone 36 or the second boarding zone 38, respectively, where the unloading and loading of passengers and/or freight takes place. Thereafter, the gondolas 6 are shifted to the second waiting zone 40 where they are accelerated towards the ascending rail portion 32" of the conveyor system 32 at controlled intervals. After the gondolas 6 have again reached the main floor 4, they are placed by means of another switch system (not shown) between the gondolas which arrive from the first boarding zone 22 and they continue their travel in the same manner as if they had remained on the main floor 4.

Figure 3:
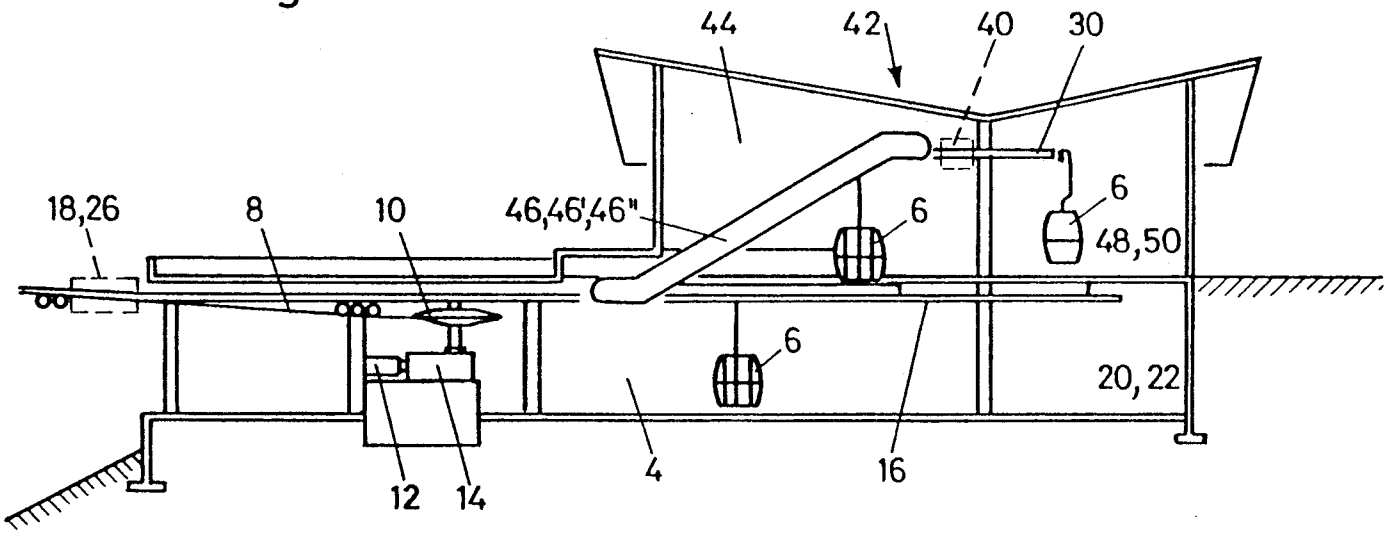
FIG. 3 is a schematic side elevational view of a cable car terminal located on the mountain (upper terminal) according to another preferred embodiment of the invention.

Turning now to FIG. 3, there is illustrated therein a corresponding mountain terminal according to the invention. In the terminal building 42 the main floor 4 is designed essentially in the same manner as described in connection with the valley station of FIGS. 1 and 2, with the exception that the secondary floor 44 is situated above the main floor 4. The rail systems of the two floors are interconnected by a conveyor system 46. The gondolas 6 entering the station are first directed to the ascending rail portion 46' and then they travel to the second debarkation zone 48 or boarding zone 50, respectively. The gondolas 6 leave the secondary floor 44 by travelling on the descending rail portion 46" of the conveyor system 46. Apart from these differences, the mode of operation is the same as described in connection with the station illustrated in FIGS. 1 and 2.

Figure 4:
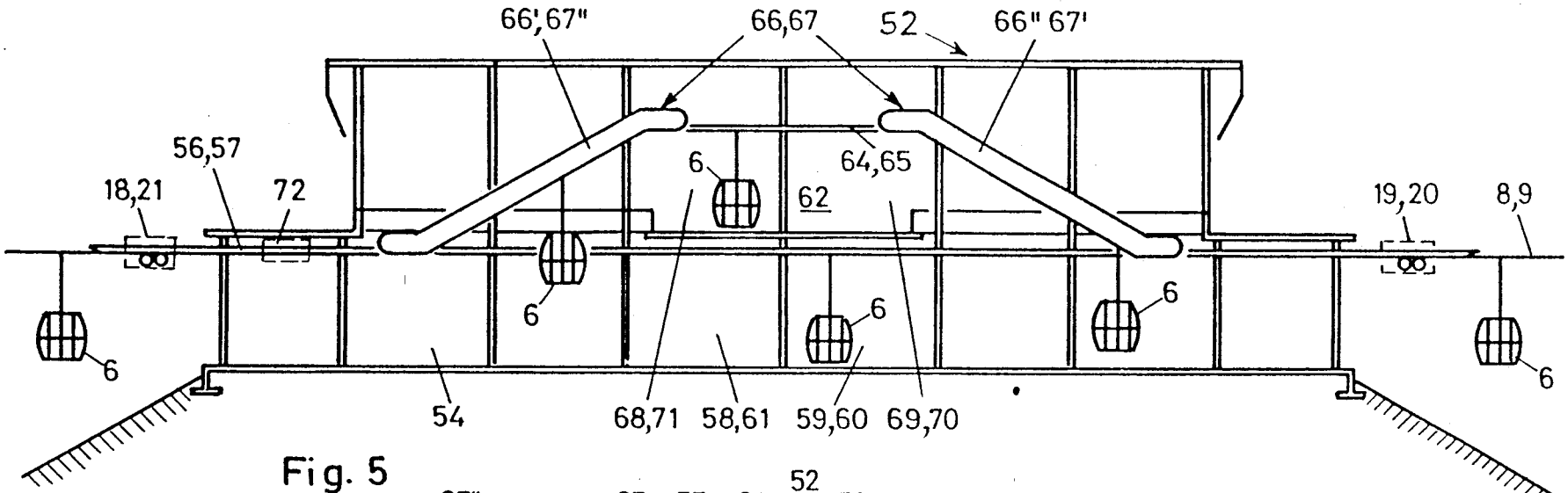
FIG. 4 is a schematic side elevational view of an intermediate cable car station, according to a further preferred embodiment.
Figure 5:
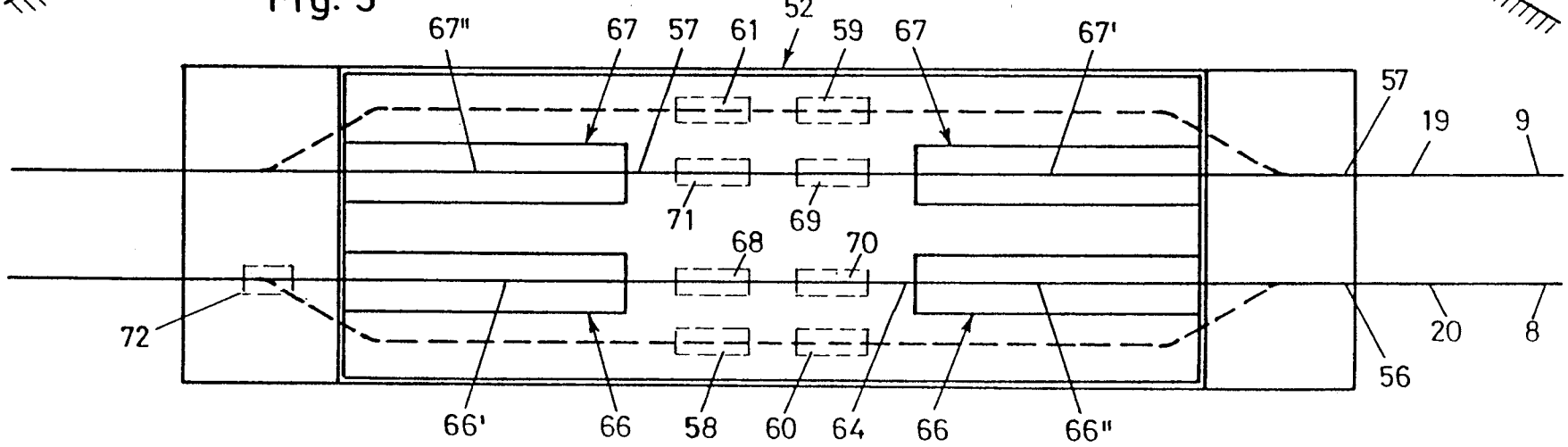
FIG. 5 is a schematic top plan view of the construction shown in FIG. 4.

Turning now to FIGS. 4 and 5, there is illustrated therein an intermediate station (that is, a station between the mountain and valley terminals) having a building 52 which may be divided into closed portions at the middle and open portions at the two ends. The main floor 54 is located essentially at ground level thus forming the first floor of the building 52. The cables 8 and 9 traverse the building 52 in opposite travelling directions. A first, continuous rail transfer system 56, 57 is mounted on the ceiling of the main floor 54 and interconnects the uncoupling zones 18 and 19 with the respective coupling zones 20 and 21. Two debarkation zones 58, 59 and two boarding zones 60, 61 are situated in the middle of the building 52. The secondary floor 62 is situated above the main floor 54 and thus constitutes the second floor of the building 52. The second rail system 64, 65 is mounted on the ceiling of the secondary floor 62. Two conveyor systems 66 and 67 each having an ascending rail portion 66', 67' and a descending rail portion 66", 67" connect the secondary floor 62 to the main floor 54. Two debarkation zones 68, 69 and two boarding zones 70, 71 are situated at the center of the secondary floor 62.

The gondolas 6 which arrive from the left as viewed in FIGS. 4 and 5 are disconnected from the cable 8 in the uncoupling zone 18. They continue their travel by inertia on the rail system 56 to a switch system 72 from which some of the gondolas 6 follow the rail system 56 while the remaining 10 gondolas 6 continue towards the ascending rail portion 66' of the conveyor system 66 to enter the secondary floor 62. The gondolas 6 handled on the main floor 54 pass through the debarkation zone 58 and the boarding zone 60 and exit the rail system 56 in the coupling zone 20. The gondolas 6 handled on the secondary floor 62 pass through the debarkation zone 68 and the boarding zone 70 and thereafter rejoin the first rail system 56 on the main floor 54 by means of the descending rail portion 66' of the conveyor system 66. In the coupling zone 20 the gondolas 6 are recoupled to the cable 8.

The gondolas 6 which arrive into the station from the right (as viewed in FIGS. 4 and 5) are moved from the uncoupling zone 19 to the coupling zone 21 while traversing the station either at the level of the main floor 54 on the rail system 57 and thus serving the debarkation zone 59 and the boarding zone 61 or at the level of the secondary floor 62 with the aid of the ascending rail portion 67' and the descending rail portion 67'' of the conveyor system 67 and serving the debarkation zone 69 and the boarding zone 71. In certain cases it may be expedient to provide a rail system and a switch system at the one or the other or both floors to allow a dispatching of the gondolas 6 in a direction opposite to that of their arrival.

Figure 6:
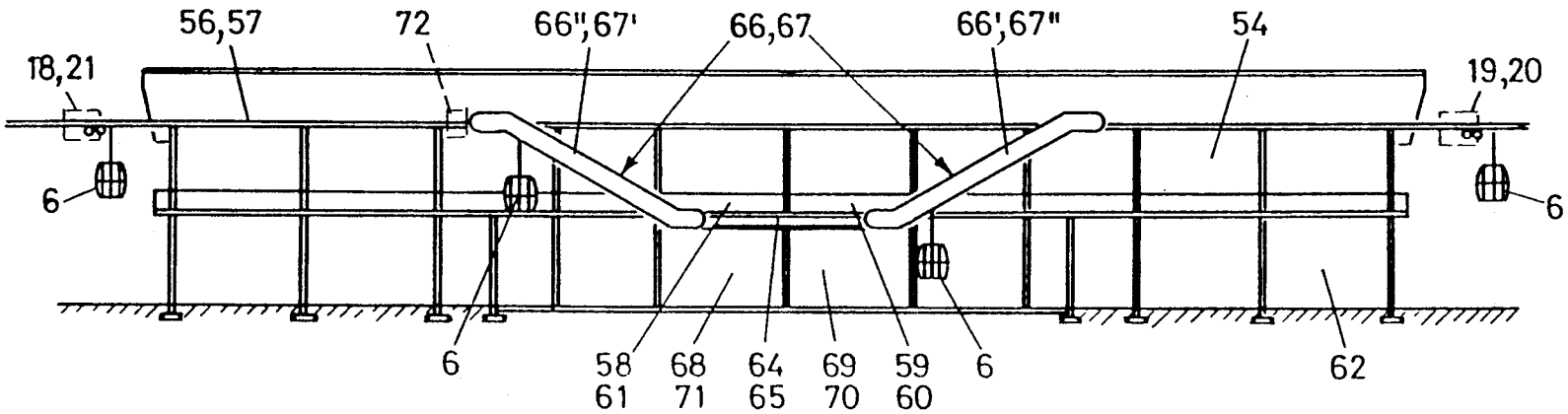
FIG. 6 is a schematic side elevational view of another preferred embodiment of an intermediate cable car station.

Turning now to FIG. 6, there is illustrated therein an intermediate station which is particularly designed to serve the needs of urban transportation. The station corresponds to that described in connection with FIGS. 4 and 5 with the sole difference that the main floor is situated above the secondary floor and the latter being situated at ground level and thus forming the first floor of the building such that the gondolas first have to descend and thereafter ascend with the aid of the conveyor system. It is apparent that it is more convenient for the passengers to debark and board at the secondary level and it is thus logical to utilize first the latter and to keep the main floor in readiness to handle rush hour traffic.

Reverting to FIG. 2, garage tracks 74 may be disposed on the main floor or the secondary floor. For an optimal utilization of the space within the buildings, however, it is preferred to provide the garage tracks 74 on the secondary level below or, respectively, above the lateral rail portions of the rail system of the principal floor.

Figure 7:
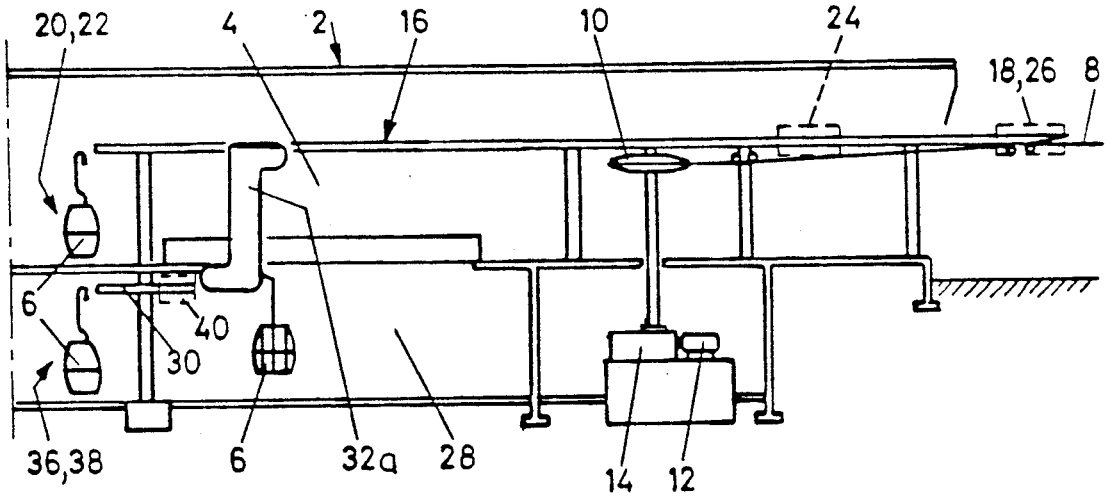
FIG. 7 is a schematic side elevational view of yet another preferred embodiment of the invention.

While the conveyor systems have, according to the described preferred embodiments, an inclined disposition, it is feasible to provide vertical conveyor systems which transfer the gondolas between the main and secondary floors. Such a vertical conveyor system is designated at 32*a* in FIG. 7 which shows a modification of the construction illustrated in FIG. 1. The gondolas may be suspended or attached to the conveyor systems. It is also feasible to place them on a conveyor system which is designed as a travelling belt, an escalator or an elevator.

The station structured according to the invention, providing for a loading and unloading of gondolas, ski lift chairs or suspended freight carriers at different levels and to give preference to one or the other level, thus makes possible a relatively compact building design and facilitates a rational use of the transportation system.

While the invention is, in the preferred embodiments, described in connection with disconnectable monocable gondolas, it is to be understood that ski lift chairs and freight gondolas of the monocable or bicable variety may be used as well.

It will be understood that the above description of the present invention is susceptible to various modifications, changes and adaptations, and the same are intended to be comprehended within the meaning and range of equivalents of the appended claims.

What is claimed is:

1. In a transportation system including a continuously moving traction cable;

a plurality of carriers connectable to and disconnectable from the traction cable;

a station for receiving, loading, unloading and dispatching the carriers; said station having a carrier entrance side and a carrier exit side;

an uncoupling zone at said entrance side for disconnecting each carrier from said traction cable;

a coupling zone at said exit side for reconnecting each carrier to said traction cable;

an unloading zone and a loading zone situated between said uncoupling zone and said coupling zone; said unloading and loading zones being situated at a first level in said station;

a transfer rail assembly extending from said uncoupling zone to said coupling zone through said unloading and loading zones for guiding the carriers disconnected from said traction cable;

the improvement comprising (a) an additional unloading zone and an additional loading zone situated between said uncoupling zone and said coupling zone at a second level; said second level being located at a height different from said first level;

(b) an additional transfer rail assembly connecting said additional unloading and loading zones with one another; and (c) a conveyor assembly connecting said uncoupling zone with said additional unloading zone and connecting said additional loading zone with said coupling zone for advancing the carriers from the uncoupling zone to the additional unloading zone and from the additional loading zone to the coupling zone.

2. A transportation system as defined in claim 1, further comprising means for selectively routing said carriers from said uncoupling zone to said unloading zone and said loading zone at said first level through said transfer rail assembly or to said additional unloading zone and said additional loading zone at said second level through said conveyor assembly and said additional transfer rail assembly.

3. A transportation system as defined in claim 1, wherein said conveyor assembly comprises an obliquely ascending portion and an obliquely descending portion.

4. A transportation system as defined in claim 1, wherein said conveyor assembly comprises a vertically ascending portion and a vertically descending portion.

5. A transportation system as defined in claim 1, wherein said station is a terminal station; and said traction cable is an endless cable having a zone of reversal; further comprising cable deflecting means in said terminal station for supporting said cable and reversing direction of travel thereof.

6. A transportation system as defined in claim 1, further wherein said traction cable is an endless cable having parallel-extending first and second flights having directions of movement opposite to one another; each flight passing through said station.

7. A transportation system as defined in claim 1, wherein said additional unloading zone and said additional loading zone are situated generally vertically below said unloading zone and said loading zone.

* * * * *